United States Patent [19]

DuBois

[11] 3,969,836

[45] July 20, 1976

[54] BUCKLE WITH REMOVABLE DISPLAY INSERT

[76] Inventor: Donald E. DuBois, 2700 Neilson Way, Santa Monica, Calif. 90405

[22] Filed: Nov. 14, 1974

[21] Appl. No.: 523,676

[52] U.S. Cl. ..... 40/21 C
[51] Int. Cl.[2] ..... G09F 3/14
[58] Field of Search ..... 40/21 C, 16, 17

[56] References Cited

UNITED STATES PATENTS

| | | | |
|---|---|---|---|
| 1,175,652 | 3/1916 | Marquette | 40/16 |
| 1,488,679 | 4/1924 | Jeannotte | 40/21 C X |
| 1,882,475 | 10/1932 | Blinckhahn | 40/21 C |

*Primary Examiner*—Louis G. Mancene
*Assistant Examiner*—Wenceslao J. Contreras
*Attorney, Agent, or Firm*—Howard L. Johnson

[57] ABSTRACT

Combined ornamental and functional buckle such as attachable to belt, shoulder or pack strap, etc. is characterized by front peripheral, channel-forming frame surrounding and edge-overlying an outwardly convex, rectangular face which thus forms a backing surface for a generally planar, inserted display card or panel having its marginal area thus held by the frame.

The indicia-bearing panel is typically like a plastic ID card having sufficient flexibility and resilience to be self-anchoring when slid edge-wise into the channel where it may flex opposite to the curvature of the backing surface. A downturned lip of the frame partially overhangs the entry slot so as to form an end abutment for the trailing edge of the panel when completely inserted. Alternate construction of two-piece buckle provides flat-sided keeper for locking insertion at entry end so as to retain both backing plate and display panel held together in the frame, the backing plate in this case not necessarily being curved.

1 Claim, 14 Drawing Figures

BUCKLE WITH REMOVABLE DISPLAY INSERT

BACKGROUND OF THE INVENTION

Belt buckles which display different emblems on their face fluctuate in popularity as one symbol or another becomes a short-time fad. Likewise one symbol may be the rage in one geographical area while at the same time a different emblem or slogan is flourishing in another area. Accordingly it would be desirable to provide a continuing stream of different emblems which could be used as interchangeable inserts for a standard buckle, rather than forming the buckle with the emblem integral therewith. However it destroys the appearance of unity if the emblem appears merely to have been stuck on as a decal, especially if its edges are visible and particularly when they appear frayed. Also, if adhesively attached, subsequent removal may prove troublesome.

Such buckles having the possibility of limitless interchangeability of face designs would have a wide usage. For example, each member of a group, such as a hiking or camping party, may require several such inserts, used as identification of various subgroups, the personnel of which may change from time to time. Thus the members of Team A and Team B may take different designations after they have made camp and been reclassified to several Patrol groups, etc. As another usage, manufacturers of various products may wish to distribute such insert panels bearing (at least in part) their label or trademark, as an advertisement.

Use of such buckles is not limited to belts but can be used on shoulder straps or jackets, or with straps used on vehicle luggage carriers or pack animals. Also, retention of such minimum identification is more certain when made a part of the user's worn belt, since this is one item of apparel which is more likely to stay with him than a loose wallet or a jacket or other separable item. Thus, when wearing only swimming trunks, a credit card can be carried in the belt buckle.

BRIEF STATEMENT OF THE INVENTION:

The invention provides a buckle which (in one form) has its forward face formed as a convex, longitudinal surface of large radius (i.e. small curvature) and generally rectangular configuration, with a narrow L-shaped rim or frame edgewise overhanging the margins so as to form, along two opposite edges, a track for sliding insertion of a planar, removable, display panel or card. Such insert desirably is of limited flexibility and resilient; when thinner than the width of such track or channel, it is self-seating when fully inserted, since in reverting to its planar position in bends opposite to the curvature of the backing surface of the buckle, and its trailing end is held by an abutment lip. An alternate construction provides a two-piece buckle in which the frame has edge walls extending rearward to form an enclosure with lengthwise retaining ribs, beneath which the display panel and backing plate may be locked by a slidable keeper. Such buckle or backing plate need not be curved and in such case the display panel may be rigid or non-bendable.

DETAILED DESCRIPTION OF PREFERRED EMBODIMENTS

Figure 1:
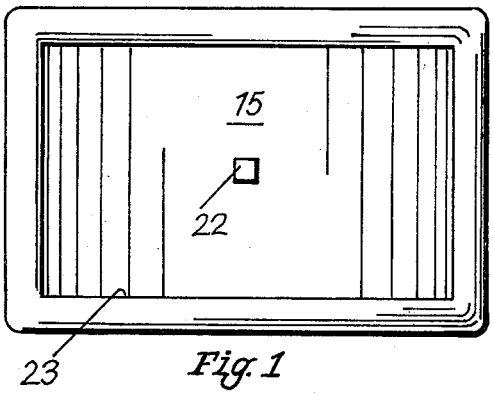
FIG. 1 is a front elevational view of the present buckle by itself.
Figure 2:
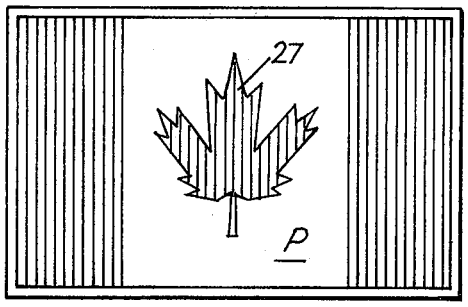
FIG. 2 is a face view of a display panel carrying a display design.
Figure 3:
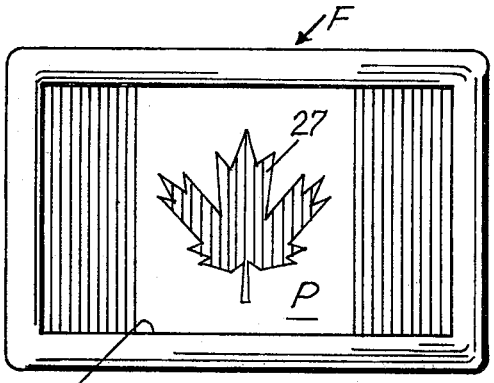
FIG. 3 is an elevational view showing the panel of FIG. 2 retained in the buckle of FIG. 1.
Figure 4:
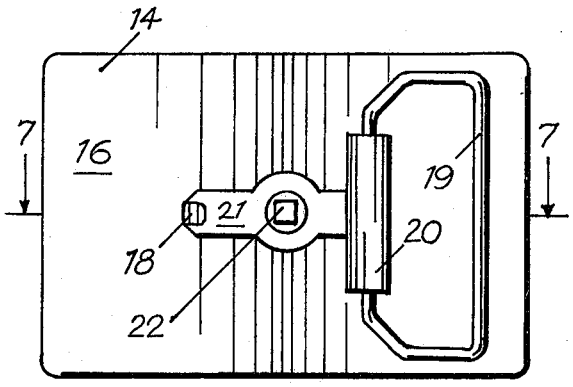
FIG. 4 is an elevational view of the rear face of the buckle.
Figure 5:
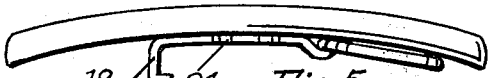
FIG. 5 is a top plan view of the buckle, particularly showing the convex, longitudinal curvature.
Figure 6:
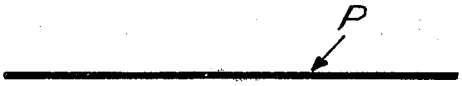
FIG. 6 is a longitudinal edge view of the display panel in its unflexed state.

As here illustrated, there is shown a typical belt buckle formed by a generally rectangular plate 14 which may be arcuately curved along its longitudinal axis so as to present a forward convex face 15 and a concave, rear surface 16. The latter may carry conventional belt attachment means such as a coupling hook 18 and straight-sided hoop 19 which is adapted to receive a belt loop (not shown). The hoop ends are pivoted in a bearing channel 20 which is carried by a mounting bracket 21 secured to the rear of plate 14 by a rivet 22 or the like. Buckles with other type coupling elements can of course be used.

Figure 9:
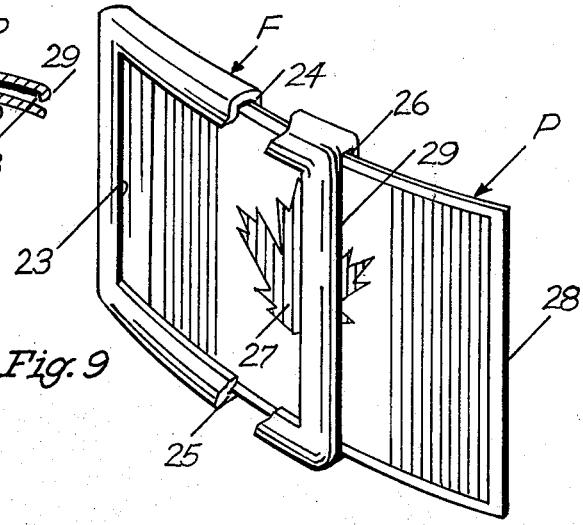
FIG. 9 is a perspective view looking down on the front of the buckle and partially inserted panel, with portions broken away to show the track.
Figure 13:
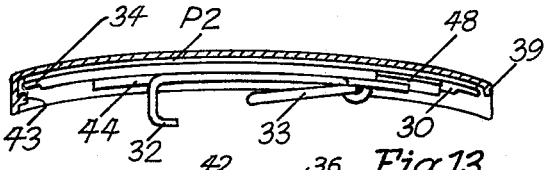
FIG. 13 is a horizontal sectional view taken on line 13—13 of FIG. 12.
Figure 14:
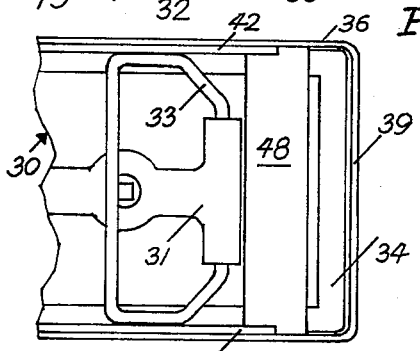
FIG. 14 is an elevational view of a portion of the rear face of the assembly of FIG. 12.

Extending forward and toward each other from the four edges of the support plate or member 14 is a generally L-shaped wall which forms an overlying, quadrangular rim or frame F surrounding an opening 23, which offset frame thus provides an upper and lower longitudinal groove or track 24, 25 (FIG. 9) in line with an entry slot 26 located at one end of the frame. Such slot provides sliding entrance to the aligned tracks for a rectangular card or panel P, which may bear any desired display emblem or insignia 27. The panel may be of stiff cardboard or of synthetic plastic (acrylic, polyethylene, etc.) such as used for conventional credit cards or ID passes for electronic locks of the card-operated type found at parking lots and security areas. Such card or panel is of limited flexibility and resilience so as normally to be planar, i.e. lie flat. However, if desired, the symbol (27) or indicia can be embossed, that is, raised above the flat background; such does not effect its use in the present buckle combination.

Figure 7:
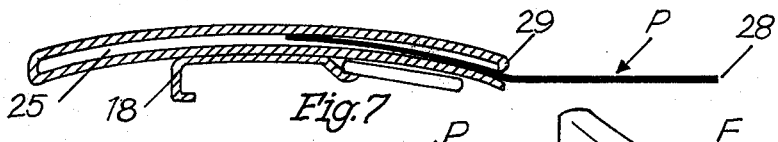
FIG. 7 is a longitudinal sectional view taken through the buckle along the line 7—7 of FIG. 4, showing a display panel partway inserted therein.
Figure 8:
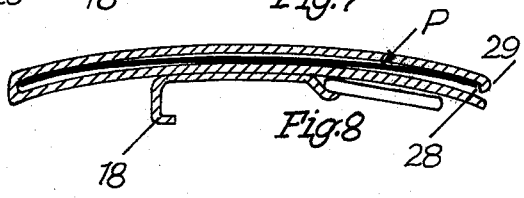
FIG. 8 is a similar view with the fully inserted panel seated therein.

As seen particularly in FIG. 7, the width of the slidable insert P is desirably less than the width of the slide channel 24, 25. This insures that when the inserted (curved) panel flexes back to the extent possible in the direction of resuming its planar shape, the trailing edge 28 will seat against the inner side of the turned back lip 29, and both ends of the panel will press forward within the channel thus effecting anchorage or self-seating. When it is subsequently desired to remove the panel P, finger pressure of the user through the face opening 23 will serve to dislodge this seated end. If desired, the entry slot can be located along the top edge instead of at the end of the buckle. The resilient card will still bend in the direction of righting itself against the inherent curvature of the buckle.

Figure 10:
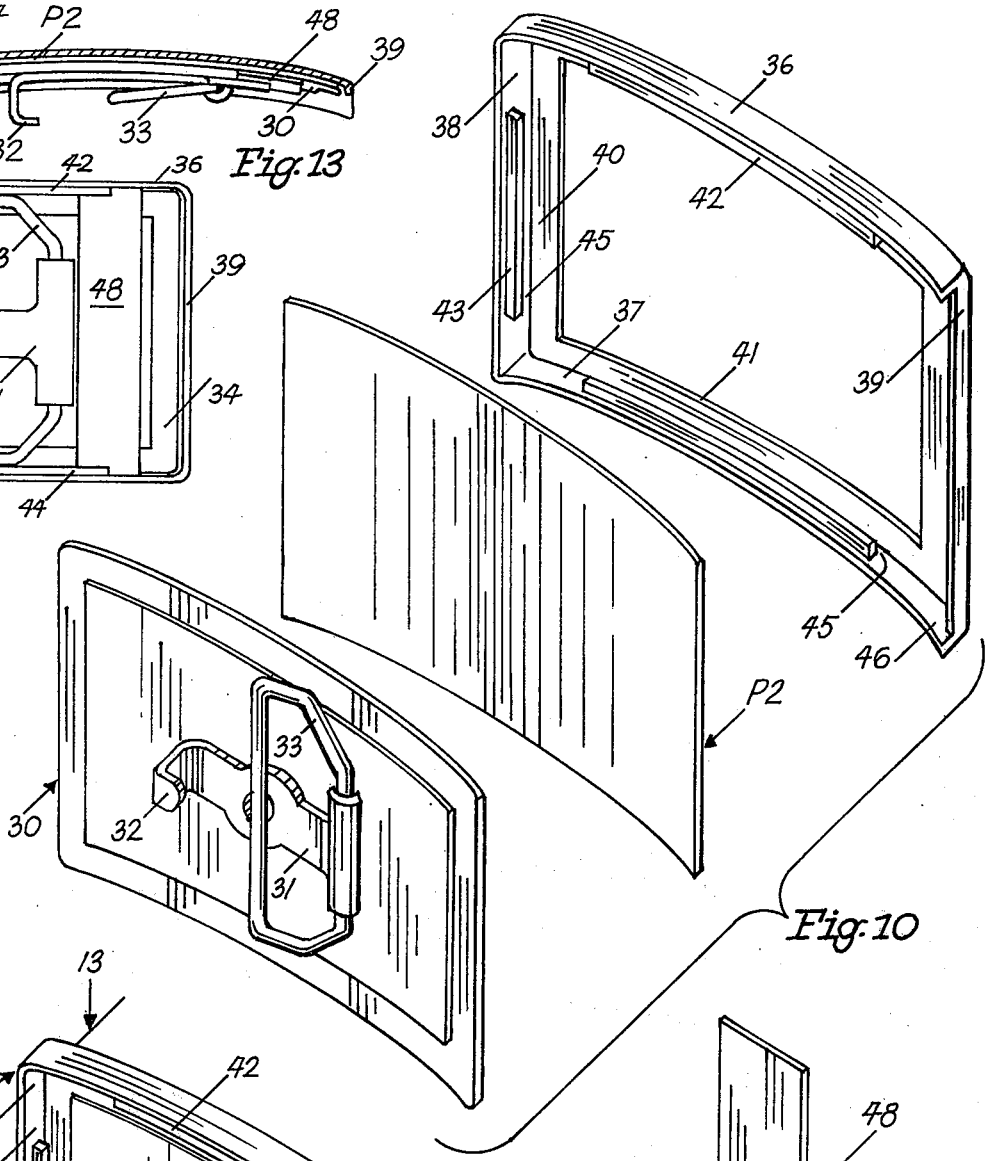
FIG. 10 is an exploded perspective view of a two-piece buckle and an interchangeable display panel which is held between them when the two pieces are fit together.

In the two-piece buckle construction of FIG. 10 et sec. there is a generally rectangular backing plate 30, which may be curved or planar as desired, having belt attachment means on its rear face, such as the illustrated bracket 31 with attachment hook 32 and pivoted hoop 33. The opposite or forward face of the plate is plane or flat. A marginal strip 34 of lesser thickness than the body of the plate, extends around all four edges of the rear face.

The border frame element 35 is of similar rectangular configuration but sufficiently larger outline than the backing plate 30 so that the latter can be seated within a rectangular enclosure formed by top 36, bottom 37, closed-end 38 and open-end 39 side walls, the enclosure being completed by a forward or face wall 40 which surrounds a display opening 41. Three of the edge walls carry elongated abutment ribs 42, 43, 44, extending along intermediate lengths of their inner surface and spaced back from the forward wall 40 a sufficient distance so as to form a channel 45 in which is inserted — loosely or tightly, depending on the thickness of the panel — both the display panel P2 and the backing plate 30.

Figure 12:
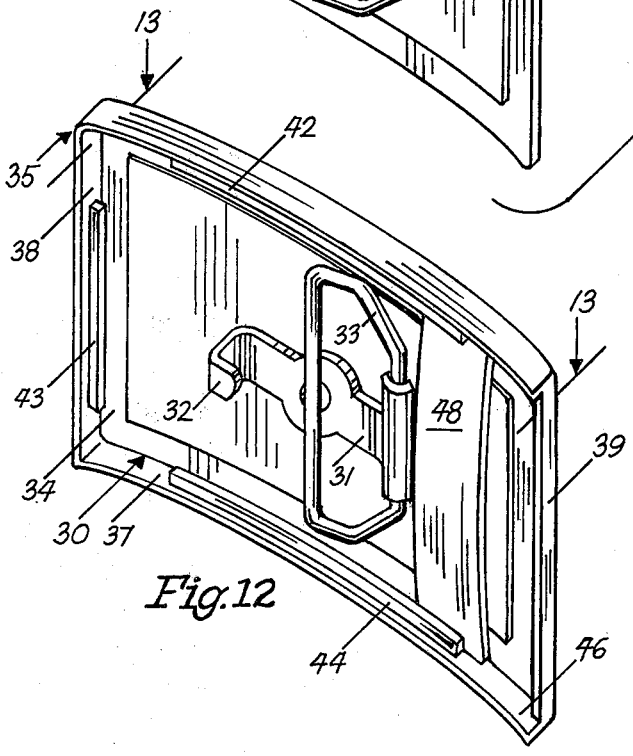
FIG. 12 is a perspective view of the assembled units of FIG. 10 with the keeper in place.
Figure 11:
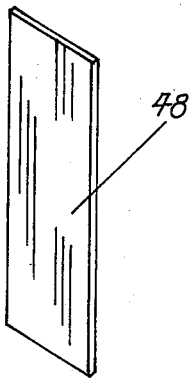
FIG. 11 is a perspective view of a keeper used to lock together the pieces of FIG. 10.

The "open" end wall 39 is of less height than the opposite wall 38, and lacks the abutment rib of the other side walls so that in effect it provides an entry mouth 46 to the channel 45. After full insertion of the panel P2 and backing plate 30 so as to seat in the channel (either both held together, or else the panel first and then the backing plate), a rectangular flat-faced keeper 48, is inserted having a height which spans or extends from the upper to the lower portions of the channel 45. The keeper is thus "wedgingly" slid into the channel between the rear face of the backing plate 30 and the upper and lower engagement ribs 42, 44. This forms a tight fit which firmly locks the panel and backing plate in place; the keeper may even buldge or bow rearward a small amount as seen (somewhat exaggerated) in FIG. 12.

I claim:

1. The combination of a resiliently-planar display panel and a buckle including strap-attachment means, a generally upstanding support plate and frame-forming walls extending forward a short distance therefrom so as to spacedly overlie the forward face of the support plate, being disposed generally parallel thereto extending at least partially about the peripheral margin of the plate and forming a longitudinally-convex channel, open along one edge for sliding insertion and removable retention of said display panel, said panel being of lesser thickness than the channel whereby its resilience disposes it to seat by flexure toward a planar position in opposition to the curvature of the channel, with its rear face in general juxtaposition with the support plate, whereby such display panels can be interchanged in the channel without disturbing a functional position or use of the buckle.

* * * * *